US010568788B2

(12) United States Patent
Cheng

(10) Patent No.: US 10,568,788 B2
(45) Date of Patent: Feb. 25, 2020

(54) MID-WHEEL DRIVE WHEELCHAIR AND SEAT UNIT

(71) Applicant: Cheng-Chun Cheng, Kaohsiung (TW)

(72) Inventor: Cheng-Chun Cheng, Kaohsiung (TW)

( * ) Notice: Subject to any disclaimer, the term of this patent is extended or adjusted under 35 U.S.C. 154(b) by 127 days.

(21) Appl. No.: 15/820,705

(22) Filed: Nov. 22, 2017

(65) Prior Publication Data

US 2018/0161221 A1 Jun. 14, 2018

(30) Foreign Application Priority Data

Dec. 14, 2016 (TW) ..... 105141405 A

(51) Int. Cl.
*A61G 5/04* (2013.01)

(52) U.S. Cl.
CPC ..... *A61G 5/048* (2016.11); *A61G 5/04* (2013.01); *A61G 5/043* (2013.01); *A61G 2203/14* (2013.01)

(58) Field of Classification Search
CPC ..... A61G 5/048; A61G 5/04; A61G 5/043; A61G 2203/14
See application file for complete search history.

(56) References Cited

U.S. PATENT DOCUMENTS 5,944,131 A 8/1999 Schaffner et al.
6,070,898 A 6/2000 Dickie et al.
7,293,801 B2 * 11/2007 Bertrand ..... A61G 5/043 280/755
7,490,683 B2 * 2/2009 Schaffner ..... A61G 5/042 180/65.1
7,828,310 B2 11/2010 Vreeswijk et al.
7,882,909 B2 * 2/2011 Pearlman ..... A61G 5/043 180/23
9,526,664 B2 * 12/2016 Mulhern ..... A61G 5/042
2004/0004342 A1 * 1/2004 Mulhern ..... G06F 9/383 280/304.1

* cited by examiner

*Primary Examiner* — Kevin Hurley
*Assistant Examiner* — Marlon A Arce
(74) *Attorney, Agent, or Firm* — Rosenberg, Klein & Lee

(57) ABSTRACT

A seat unit includes a first seat frame and a second seat frame. The first seat frame is connected with a drive carrier and includes at least one first mounting portion. The second seat frame includes wheel frames and a mounting frame fixedly connected with the wheel frames. Each wheel frame is mounted with an auxiliary wheel. A space is defined between the mounting frame and the wheel frames. The drive carrier is located in the space. The mounting frame includes at least one second mounting portion. One of the first mounting portion and the second mounting portion is a rod, and the other is a receiving portion. The rod is movably inserted through the receiving portion. When the second seat frame is displaced relative to the first seat frame, the auxiliary wheels of the wheel frames can move together relative to the drive wheels of the drive carrier.

8 Claims, 8 Drawing Sheets

MID-WHEEL DRIVE WHEELCHAIR AND SEAT UNIT

FIELD OF THE INVENTION

The present invention relates to a mid-wheel drive wheelchair and a seat unit thereof, and more particularly to a seat unit able to reduce the steering load of a drive carrier of the mid-wheel drive wheelchair.

BACKGROUND OF THE INVENTION

A mid-wheel drive moving device has the feature of a small radius of gyration, and is applied to a wheelchair that is used in a small space (such as, an indoor space). The moving device has a pair of middle wheels driven by different drive motors respectively. By controlling the pair of middle wheels at different rotational speeds or the same rotational speed, the moving device can torn left or right or move forward or backward.

The related prior art includes U.S. Pat. No. 5,944,131 titled "mid-wheel drive power wheelchair", U.S. Pat. No. 7,828,310 titled "chassis structure for mid-wheel drive power wheelchair", U.S. Pat. No. 6,070,898 titled "suspension system for a wheelchair", and so on.

These mid-wheel drive moving devices are usually equipped with front and rear auxiliary wheels to increase the stability of the movement so as to avoid turnover. However, in some situations, these auxiliary wheels may excessively increase the load of the drive wheels (middle wheels), which may easily cause overloading of the drive motors. For example, when the front auxiliary wheels are at a higher position relative to the drive wheels and the user controls the drive wheels to steer, the front auxiliary wheels and the rear auxiliary wheels cannot move smoothly because they are not in contact with the ground, so that when the drive wheels are steered in this situation, the front and rear auxiliary wheels form an obstruction to increase the load of the drive wheels. Accordingly, the inventor of the present invention has devoted himself based on his many years of practical experiences to solve these problems.

SUMMARY OF THE INVENTION

The primary object of the present invention is to provide a mid-wheel drive wheelchair and a seat unit thereof.

According to one aspect of the present invention, a seat unit used for a drive carrier is provided. The drive carrier comprises two drive wheels. The respective rotational speeds of the two drive wheels can be controlled individually. The seat unit comprises a first seat frame and a second seat frame. The first seat frame is connected with the drive carrier. The first seat frame includes at least one first mounting portion. The second seat frame includes a plurality of wheel frames and a mounting frame fixedly connected with the wheel frames. Each of the wheel frames is mounted with an auxiliary wheel. A space is defined between the mounting frame and the wheel frames. The drive carrier is located in the space. The mounting frame includes at least one second mounting portion. One of the first mounting portion and the second mounting portion is a rod. The other of the first mounting portion and the second mounting portion is a receiving portion. The rod is movably inserted through the receiving portion. When the second seat frame is displaced relative to the first seat frame, all the auxiliary wheels of the wheel frames can move together relative to the drive wheels of the drive carrier.

Preferably, the first seat frame includes two first side rods opposite to each other and two first connecting rods. Each of the first side rods has the first mounting portion. The first connecting rods are opposite to each other and connected to the first side rods. The mounting frame includes two second side rods opposite to each other and two second connecting rods. Each of the second side rods has the second mounting portion. The second connecting rods are opposite to each other and connected to the second side rods.

Preferably, the rod and the receiving portion are substantially perpendicular to a horizontal plane, and a slip member is provided between the rod and the receiving portion. The slip member may be a linear bearing.

Preferably, the seat unit further comprises a pedal rod. The pedal rod is connected to the second seat frame.

Preferably, the rod has a limit portion for limiting a relative displacement distance between the first seat frame and the second seat frame.

Preferably, the seat unit further comprises an elastic member. The elastic member is connected between the first seat frame and the second seat frame as a buffer when the second seat frame is displaced relative to the first seat frame.

Preferably, the elastic member is a spring sleeved on the rod.

Preferably, the first seat frame is movably connected to the drive carrier. The second seat frame has a pair of contact rods corresponding to the drive wheels of the drive carrier. When the drive carrier is displaced relative to the first seat frame, the contact rods lean against the drive wheels.

According to another aspect of the present invention, a mid-wheel drive wheelchair is provided. The mid-wheel drive wheelchair comprises a drive carrier and a seat unit. The drive carrier comprises two drive wheels. The respective rotational speeds of the two drive wheels can be controlled individually. The seat unit comprises a seat, a first seat frame, and a second seat frame. The seat is fixedly mounted on the first seat frame. The first seat frame is connected with the drive carrier. The first seat frame includes at least one first mounting portion. The second seat frame includes a plurality of wheel frames and a mounting frame fixedly connected with the wheel frames. Each of the wheel frames is mounted with an auxiliary wheel. A space is defined between the mounting frame and the wheel frames. The drive carrier is located in the space. The mounting frame includes at least one second mounting portion. One of the first mounting portion and the second mounting portion is a rod. The other of the first mounting portion and the second mounting portion is a receiving portion. The rod is movably inserted through the receiving portion. The rod and the receiving portion are substantially perpendicular to a horizontal plane. A linear bearing is provided between the rod and the receiving portion. When the second seat frame is displaced relative to the first seat frame, all the auxiliary wheels of the wheel frames can move together relative to the drive wheels of the drive carrier.

Preferably, the drive carrier is a balance car. The drive carrier further includes an operating module. The operating module is mounted on the seat or extends to the seat for controlling the rotational speeds of the drive wheels.

According to the above technical features, the present invention can achieve the following effects:

1. The seat unit is composed of the first seat frame connected with the drive carrier and the second seat frame mounted with the auxiliary wheels, and the first seat frame and the second seat frame can be relatively displaced, so that all the auxiliary wheels can move together relative to the drive wheels of the drive carrier. The drive wheels of the drive carrier won't be hindered by the auxiliary wheels during steering, thereby improving the steering smoothness and reducing the steering load of the drive carrier.

2. The second seat frame mounted with the auxiliary wheels does not directly bear the weight of the rider, so the second seat frame can be easily displaced relative to the first seat frame. The drive wheels of the drive carrier won't be hindered by the auxiliary wheels during steering.

3. The first mounting portion of the first seat frame and the second mounting portion of the second seat frame are disposed oppositely to provide a stable relative displacement.

4. The relative displacement between the first seat frame and the second seat frame can improve the smoothness of displacement by the aid of the slip member.

5. The second seat frame is mounted with the pedal rod so that the legs of the rider can be ascended and descended along with the displacement of the second seat frame.

6. The displacement stroke between the first seat frame and the second seat frame can be limited by the limit portion so as to avoid excessive displacement or detachment.

7. The first seat frame and the second seat frame can be cushioned by the elastic member so as to improve the comfort of riding.

8. The elastic member may adopt a spring sleeved on the rod, which can be stably compressed and stretched.

9. The second seat frame may have the contact rods to limit the moving range of the drive carrier.

10. The drive carrier may adopt a conventional balance car on the market. Compared to a self-developed drive carrier, the balance car is cost-effective and can be obtained easily.

DETAILED DESCRIPTION OF THE PREFERRED EMBODIMENTS

Embodiments of the present invention will now be described, by way of example only, with reference to the accompanying drawings.

Figure 1:
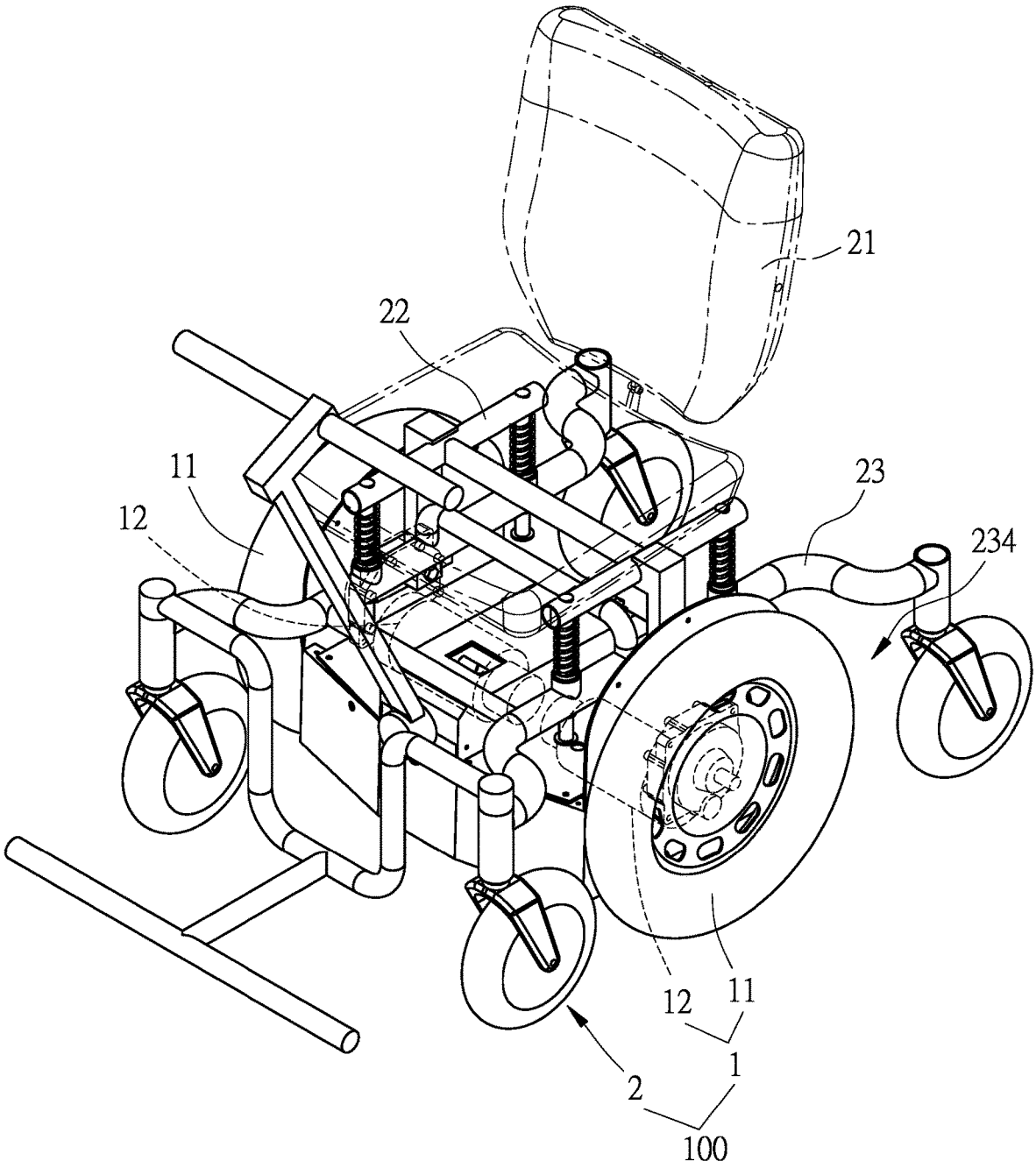
FIG. 1 is a perspective view according to a first embodiment of the present invention.

Referring to FIG. 1, a mid-wheel drive wheelchair (100) according to an embodiment of the present invention comprises a drive carrier (1) and a seat unit 2. The drive carrier (1) comprises two drive wheels (11). The rotational speeds of the two drive wheels (11) can be controlled individually. Specifically, the drive carrier (1) includes two drive motors (12) respectively connected with the drive wheels (11), so that the respective rotational speeds of the drive motors (12) can be individually controlled by a control unit, that is, the respective rotational speeds of the drive wheels (11) can be controlled individually. In this embodiment, the drive carrier (1) adopts a balance car. Therefore, a built-in gyroscope is used to determine the state of the balance car. After the processor calculates an appropriate command, the drive motor is controlled to achieve a balance effect. However, it is not limited to a balance car. The balance car is cost-effective and can be obtained easily.

Figure 2:
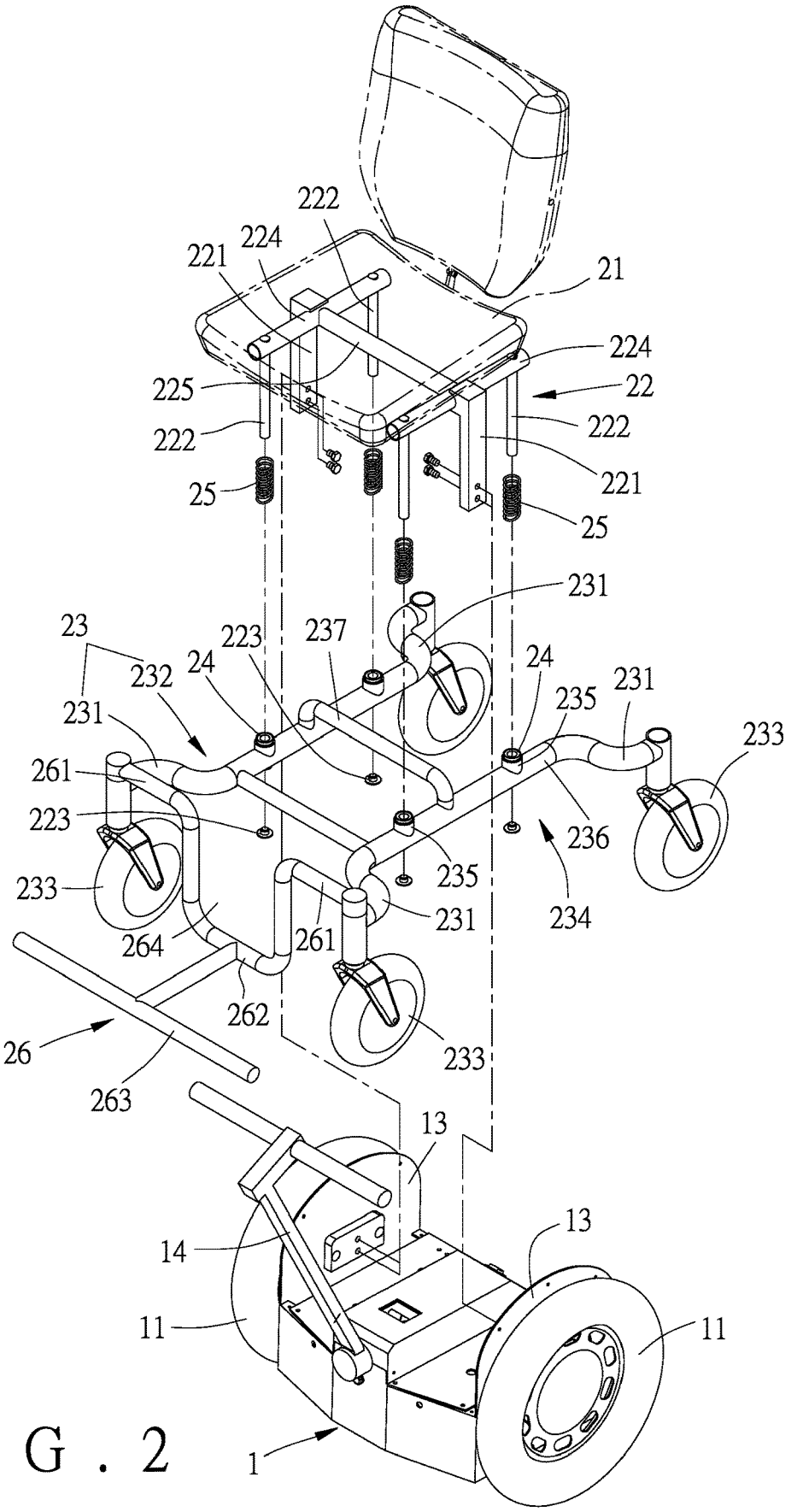
FIG. 2 is an exploded view according to the first embodiment of the present invention.

Please refer to FIG. 2 in conjunction with FIG. 1. The seat unit (2) includes a seat (21), a first seat frame (22), and a second seat frame (23). The seat (21) is fixedly mounted on the first seat frame (22) by locking, snapping, engaging or the like. The first seat frame (22) is connected to the drive carrier (1). For example, the first seat frame (22) includes a pair of fixing rods (221). The drive carrier (1) includes a pair of side plates (13). The pair of fixing rods (221) are fixedly connected to the pair of side plates (13) by locking, snapping, engaging, or the like, so that the first seat frame (22) and the drive carrier (1) can be assembled together to be one-piece, but not limited thereto. It may be a movable relationship (for example, pivotal connection) that can be relatively displaced. The second seat frame (23) includes a plurality of wheel frames (231) and a mounting frame (232) fixedly connected with the wheel frames (231). Each wheel frame (231) is mounted with an auxiliary wheel (233) capable of steering. For example, the auxiliary wheel (233) may be a movable caster, thereby allowing a 360-degree rotation. A space (234) is defined between the mounting frame (232) and the wheel frames (231). The drive carrier (1) is located in the space (234). Preferably, the drive carrier (1) may further include an operating module (14). The operating module (14) may be an operating rod extending outward from the space (234) to be located in front of the seat (21) so that the user can control the respective rotational speeds of the drive wheels (11).

Figure 3:
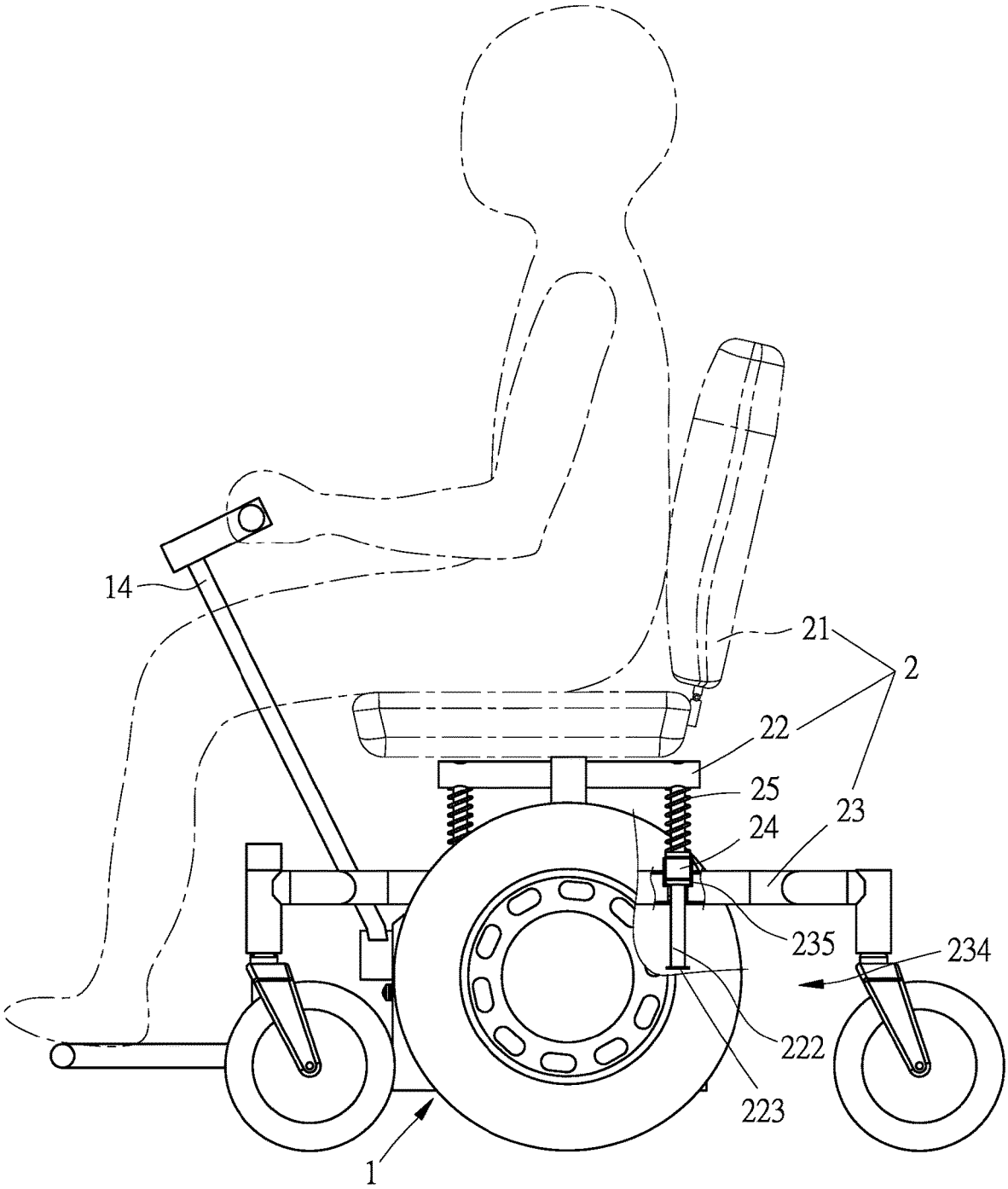
FIG. 3 is a side schematic view according to the first embodiment of the present invention, showing a partial section of the first mounting portion and the second mounting portion.

As shown in FIG. 2 and FIG. 3, the first seat frame (22) includes a plurality of first mounting portions (222). The mounting frame (232) of the second seat frame (23) includes a plurality of second mounting portions (235). The first mounting portions (222) are rods. The second mounting portions (235) are receiving portions (such as, through holes or troughs). The rods are movably inserted through the receiving portions. The distal end of each rod may be formed with a limit portion (223) by combining an object with a larger diameter, thereby limiting the relative displacement distance between the first seat frame (22) and the second seat frame (23). It should be noted that the arrangement relationship between the rods and the receiving portions may be changed, that is, the first seat frame (22) is provided with the receiving portions, and the mounting frame (232) is provided with the plurality of rods. The purpose of allowing the first seat frame (22) and the second seat frame (23) to be displaced relative to each other may be achieved. In this embodiment, both the rods and the receiving portions are substantially perpendicular to a horizontal plane. A slip member (24) (e.g., a linear bearing or a self-lubricating bearing) is disposed between the rod and the receiving portion. Preferably, the seat unit (2) further includes an elastic member (25). The elastic member (25) is connected between the first seat frame (22) and the second seat frame (23) as a buffer when the second seat frame (23) is displaced relative to the first seat frame (22). For example, the elastic member (25) may be a spring sleeved on each rod.

Referring to FIG. 2 and FIG. 3, in detail, the first seat frame (22) includes two first side rods (224) opposite to each other and two first connecting rods (225). The first side rods (224) have the first mounting portions (222), respectively. The first connecting rods (225) are opposite to each other and connected to the first side rods (224). The mounting frame (232) includes two second side rods (236) opposite to each other and two second connecting rods (237). The second side rods (236) have the second mounting portions (235), respectively. The auxiliary wheel (233) is mounted on both ends of each second side rod (236). Therefore, the front and the rear of the mid-wheel drive wheelchair (100) are provided with two auxiliary wheels (233), respectively. The second connecting rods (237) are opposite to each other and connected to the second side rods (236). Preferably, the seat unit (2) further includes a pedal rod (26). The pedal rod (26) comprises two coupling rods (261), an extension portion (262), and a pedal portion (263). The coupling rods (261) are installed to the second seat frame (23), and the installation position may share the same installation position with the auxiliary wheel (233), thereby reducing the structural complexity. The extension portion (262) connects the coupling rods (261) and the pedal portion (263). The extension portion (262) defines a turning space (264) for movement of the operating rod.

Figure 4:
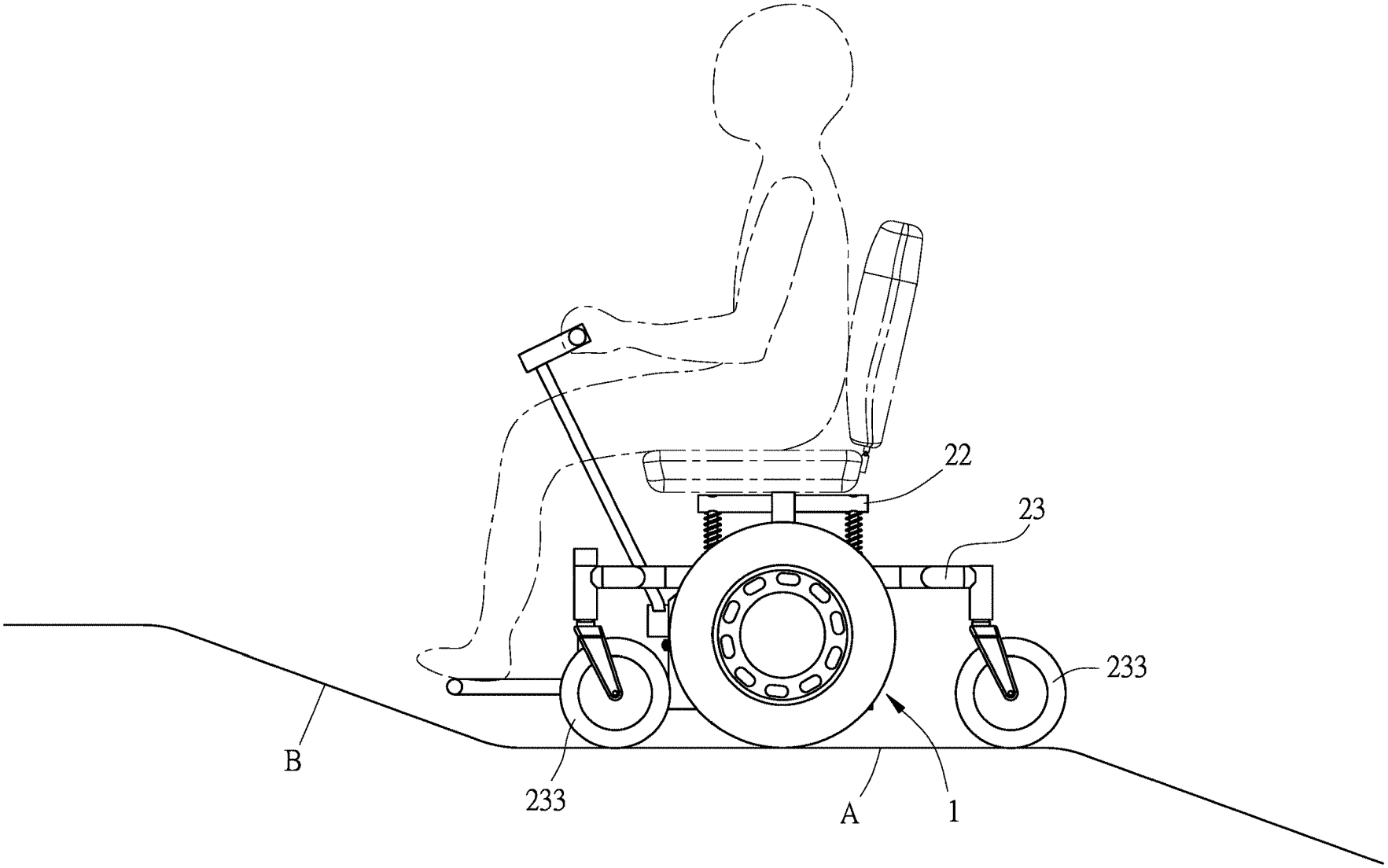
FIG. 4 is a first schematic view according to the first embodiment of the present invention when in use.
Figure 5:
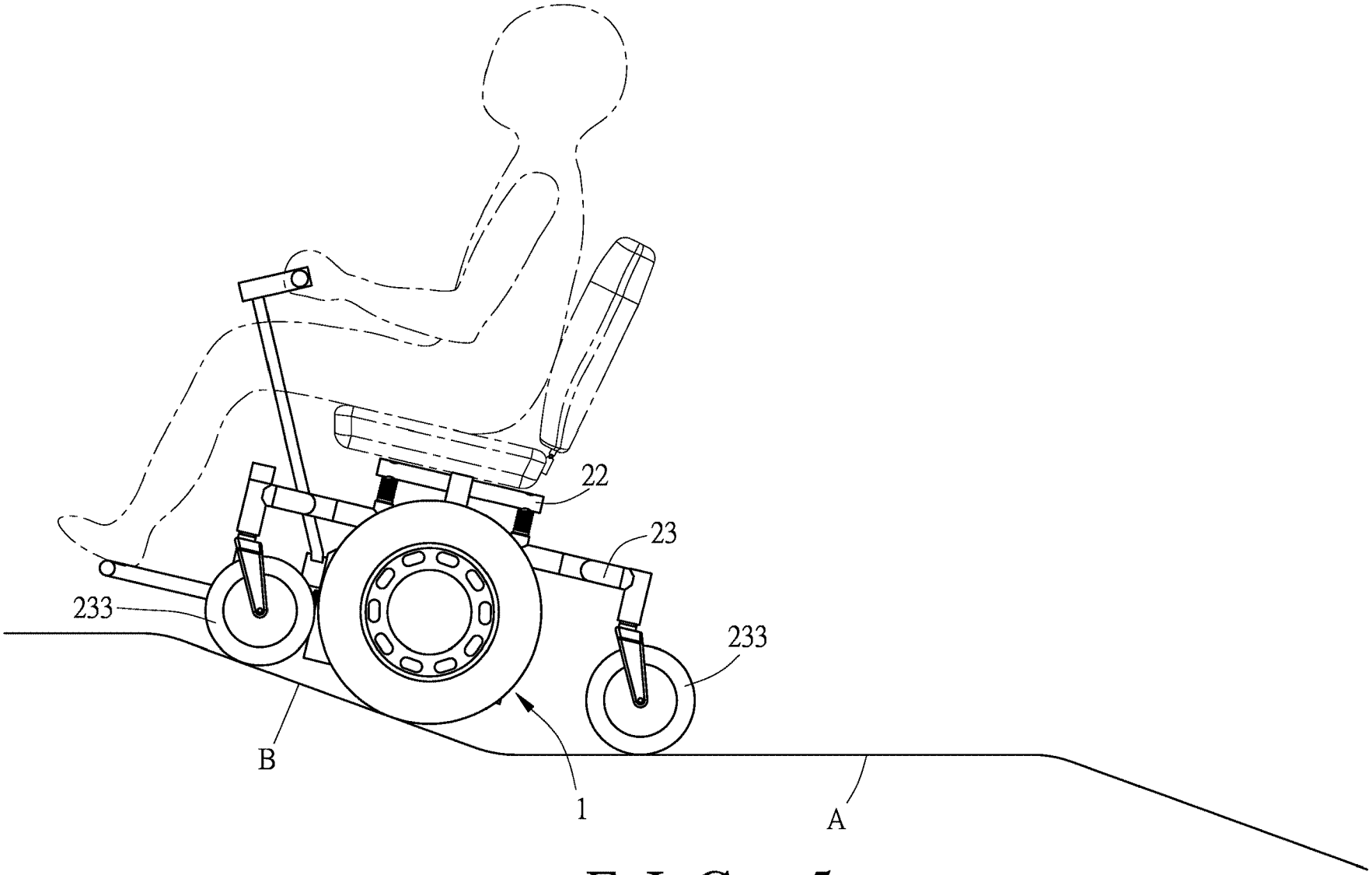
FIG. 5 is a second schematic view according to the first embodiment of the present invention when in use.

In use, referring to FIG. 4 and FIG. 5, when the mid-wheel drive wheelchair (100) is moved from a flat ground (A) to a higher ground (B), all the auxiliary wheels (233) can move together relative to the drive wheels (11) of the drive carrier (1) because the seat unit (2) is composed of the first seat frame (22) connected with the drive carrier (1) and the second seat frame (23) mounted with the auxiliary wheels (233), and the first seat frame (22) and the second seat frame (23) can be relatively displaced. The drive wheels (11) of the drive carrier (1) won't be hindered by the auxiliary wheels (233) during steering, thereby improving the steering smoothness and reducing the steering load of the drive carrier (1).

Figure 6:
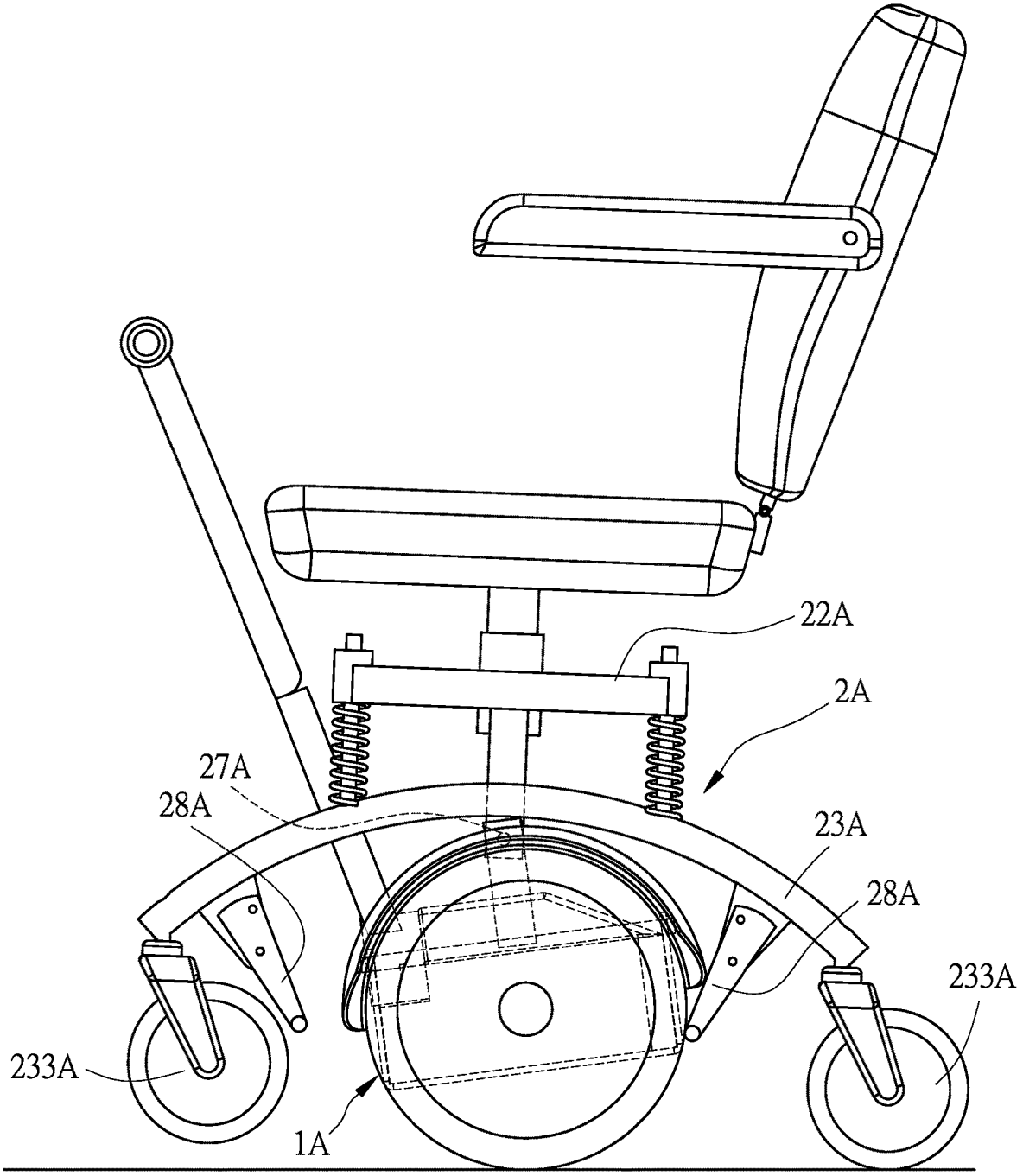
FIG. 6 is a side schematic view according to a second embodiment of the present invention.

Referring to FIG. 6, a second embodiment of the present invention comprises a drive carrier (1A) and a seat unit (2A) as the first embodiment. The seat unit (2A) is also composed of a first seat frame (22A) connected with the drive carrier (1A) and a second seat frame (23A) mounted with auxiliary wheels (233A). The second embodiment is substantially similar to the first embodiment with the exception described hereinafter. The first seat frame (22A) is movably connected to the drive carrier (1A). Specifically, in the second embodiment, the first seat frame (22A) and the drive carrier (1A) are pivotally connected by a pivot member (27A), so that the drive carrier (1A) can be pivoted relative to the first seat frame (22A). Preferably, the second seat frame (23A) has a pair of contact rods (28A) corresponding to the drive wheels (11A) of the drive carrier (1A). When the drive wheels (11A) of the drive carrier (1A) stop running and the drive carrier (1A) is displaced relative to the first seat frame (22A), the contact rods (28A) lean against the drive wheels (11A) to limit the pivot angle of the drive carrier (1A).

Figure 7:
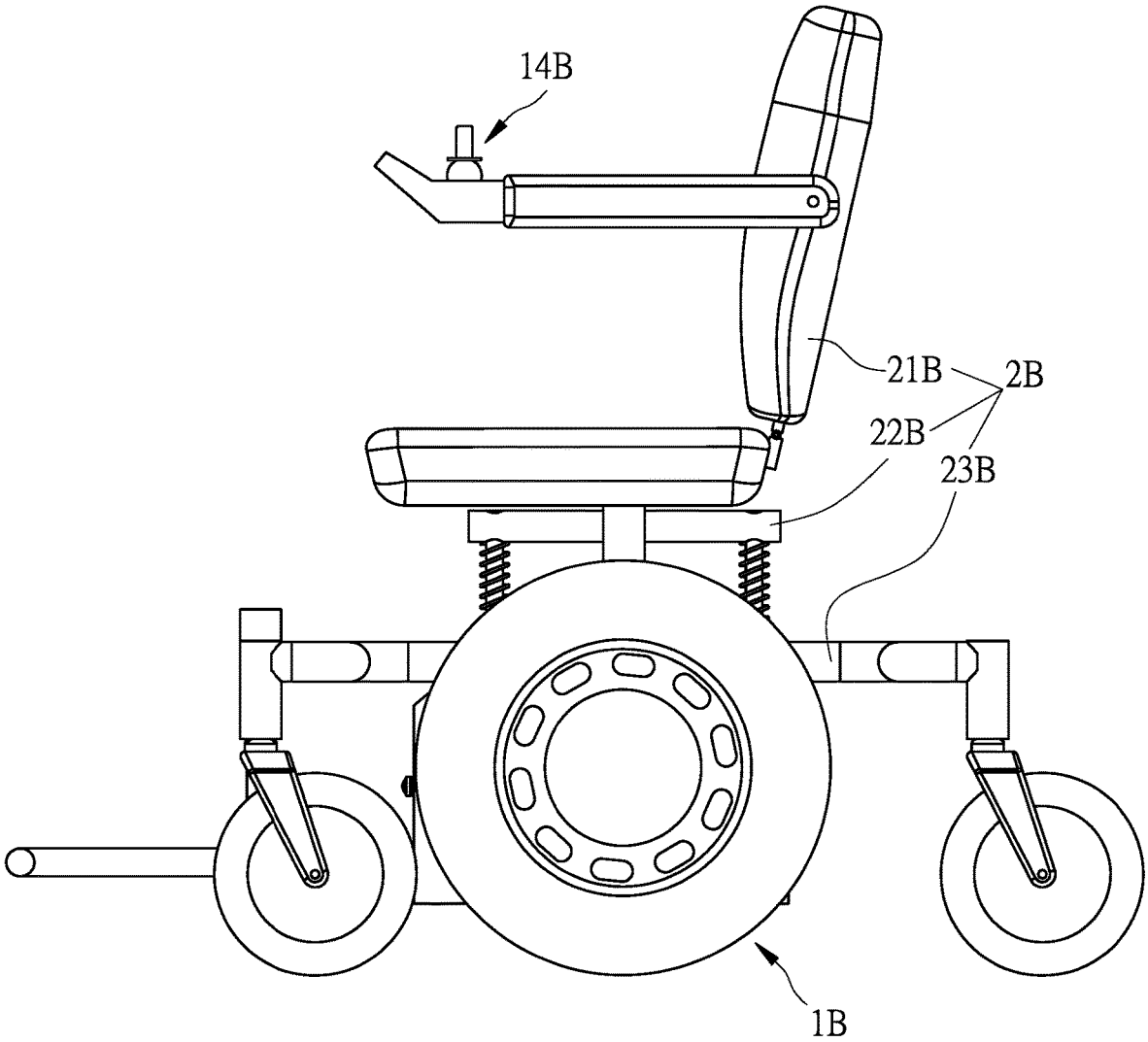
FIG. 7 is a side schematic view according to a third embodiment of the present invention.

Referring to FIG. 7, a third embodiment of the present invention comprises a drive carrier (1B) and a seat unit (2B) as the first embodiment. The drive carrier (1B) also includes an operating module (14B). The seat unit (2B) also includes a seat (21B), a first seat frame (22B) and a second seat frame (23B). The third embodiment is substantially similar to the first embodiment with the exception described hereinafter. The operating module (14B) is mounted on the seat (21B) (for example, on the armrest), and the operating module (14B) may include a small joystick.

Figure 8:
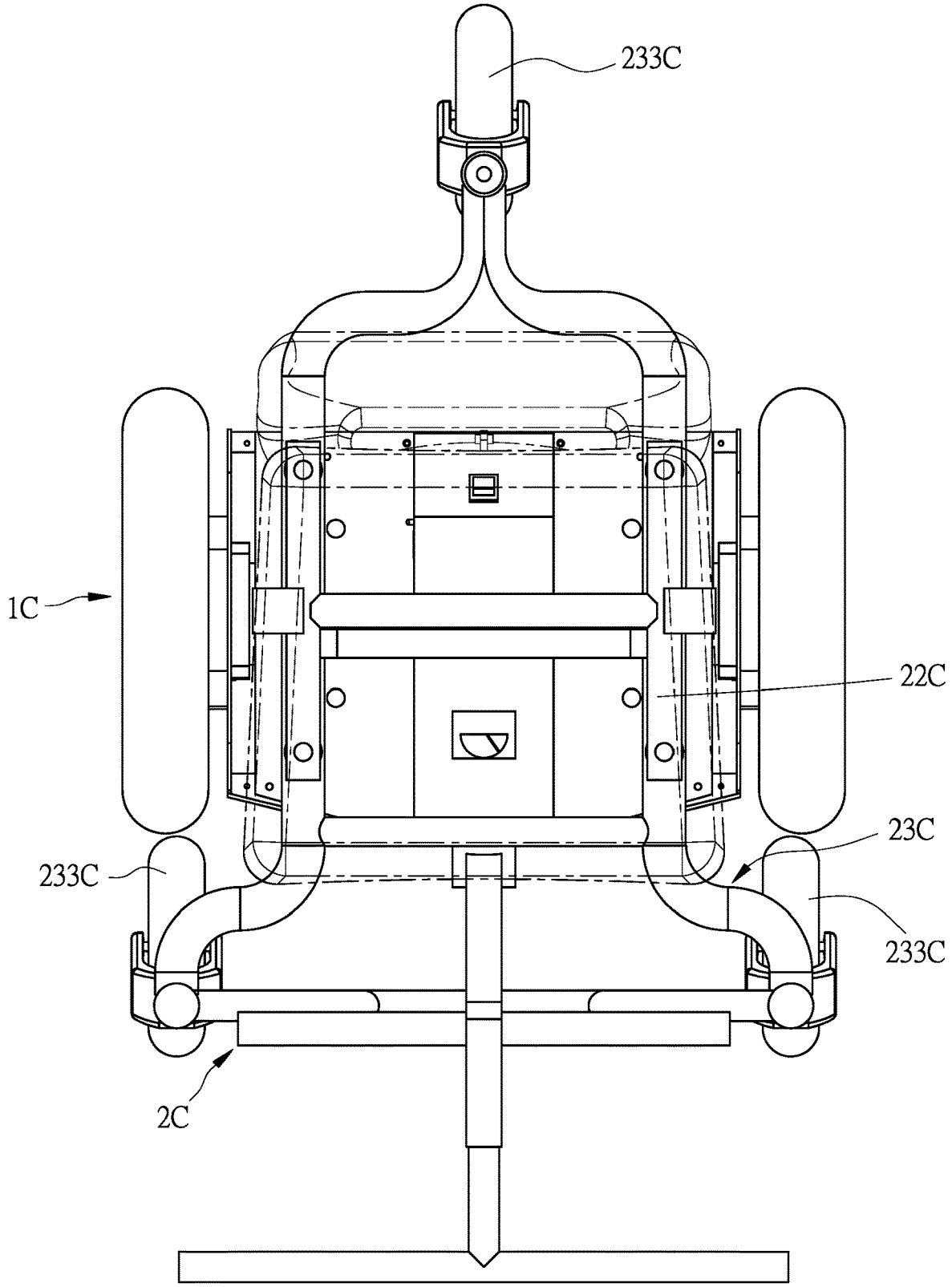
FIG. 8 is a top schematic view according to a fourth embodiment of the present invention.

Referring to FIG. 8, a fourth embodiment of the present invention comprises a drive carrier (1C) and a seat unit (2C) as the first embodiment. The seat unit (2C) is also composed of a first seat frame (22C) connected with the drive carrier (1C) and a second seat frame (23C) mounted with a plurality of auxiliary wheels (233C). The fourth embodiment is substantially similar to the first embodiment with the exception described hereinafter. The number of the auxiliary wheels (233C) at one side is plural, but the number of the auxiliary wheels (233C) at the other side may be a single.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A seat unit, used for a drive carrier, the drive carrier including two drive wheels, respective rotational speeds of the two drive wheels are controlled individually, the seat unit comprising:

a first seat frame movably connected with the drive carrier, the first seat frame including at least one first mounting portion; and a second seat frame, including a plurality of wheel frames and a mounting frame fixedly connected with the wheel frames, each of the wheel frames being mounted with an auxiliary wheel, a space being defined between the mounting frame and the wheel frames, the drive carrier being located in the space, the mounting frame including at least one second mounting portion, one of the first mounting portion and the second mounting portion being a rod, the other of the first mounting portion and the second mounting portion being a receiving portion, the rod being movably inserted through the receiving portion, wherein when the second seat frame is displaced relative to the first seat frame, all the auxiliary wheels of the wheel frames move together relative to the drive wheels of the drive carrier; wherein the second seat frame has a pair of contact rods corresponding to the drive wheels of the drive carrier, and when the drive carrier is displaced relative to the first seat frame, the contact rods lean against the drive wheels.

2. The seat unit as claimed in claim 1, wherein the first seat frame includes two first side rods opposite to each other and two first connecting rods, each of the first side rods has the first mounting portion, the first connecting rods are opposite to each other and connected to the first side rods, the mounting frame includes two second side rods opposite to each other and two second connecting rods, each of the second side rods has the second mounting portion, and the second connecting rods are opposite to each other and connected to the second side rods.

3. The seat unit as claimed in claim 2, wherein the rod and the receiving portion are substantially perpendicular to a horizontal plane, and a slip member is provided between the rod and the receiving portion.

4. The seat unit as claimed in claim 2, further comprising a pedal rod, the pedal rod being connected to the second seat frame.

5. The seat unit as claimed in claim 2, wherein the rod has a limit portion for limiting a relative displacement distance between the first seat frame and the second seat frame.

6. The seat unit as claimed in claim 2, further comprising an elastic member, the elastic member being connected between the first seat frame and the second seat frame as a buffer when the second seat frame is displaced relative to the first seat frame.

7. The seat unit as claimed in claim 6, wherein the elastic member is a spring sleeved on the rod.

8. A mid-wheel drive wheelchair, comprising:

a drive carrier including two drive wheels, the drive carrier is a balance car and includes an operating module, respective rotational speeds of the two drive wheels are controlled individually; and a seat unit including a seat, a first seat frame, and a second seat frame, the seat being fixedly mounted on the first seat frame, the first seat frame being connected with the drive carrier, the first seat frame including at least one first mounting portion, the second seat frame including a plurality of wheel frames and a mounting frame fixedly connected with the wheel frames, each of the wheel frames being mounted with an auxiliary wheel, a space being defined between the mounting frame and the wheel frames, the drive carrier being located in the space, the mounting frame including at least one second mounting portion, one of the first mounting portion and the second mounting portion being a rod, the other of the first mounting portion and the second mounting portion being a receiving portion, the rod being movably inserted through the receiving portion, the rod and the receiving portion being substantially perpendicular to a horizontal plane, a linear bearing being provided between the rod and the receiving portion, wherein when the second seat frame is displaced relative to the first seat frame, all the auxiliary wheels of the wheel frames move together relative to the drive wheels of the drive carrier; wherein the operating module is mounted on the seat or extends to the seat for controlling the rotational speeds of the drive wheels.

* * * * *